United States Patent [19]

Atsumi

[11] 4,242,548

[45] Dec. 30, 1980

[54] LIMIT SWITCH

[75] Inventor: Haruo Atsumi, Otsu, Japan

[73] Assignee: Omron Tateisi Electronics Co., Kyoto, Japan

[21] Appl. No.: 22,301

[22] Filed: Mar. 20, 1979

[30] Foreign Application Priority Data

Mar. 31, 1978 [JP] Japan ..... 53-38700

[51] Int. Cl.[3] ..... H01H 3/16

[52] U.S. Cl. ..... 200/47

[58] Field of Search ..... 200/47, 153 LB, 153 N, 200/153 T, 330, 336; 74/54, 99 R

[56] References Cited

U.S. PATENT DOCUMENTS

| | | | |
|---|---|---|---|
| 2,328,266 | 8/1943 | Durbin | 200/47 |
| 3,512,422 | 5/1970 | Aslan | 200/47 |
| 3,749,860 | 7/1973 | Crepeau | 200/47 |
| 3,793,492 | 2/1974 | Duncan et al. | 200/47 |

*Primary Examiner*—John W. Shepperd

*Attorney, Agent, or Firm*—Stevens, Davis, Miller & Mosher

[57] ABSTRACT

A limit switch comprises a snap action switch component and an actuator, said actuator being constructed so as to selectively actuate the snap action switch component with respect to the rotating direction of a rotating shaft of the actuator. A rotational motion of the rotating shaft is transmitted to the snap action switch component through a pair of levers and a driving plunger member. The pair of levers are pivotally secured under the rotating shaft and the driving plunger member is rotatably and reciprocatingly secured under said pair of levers. Free ends of the levers are selectively engageable with the top surface of the driving plunger member, an upper portion of which is partially cut out. By setting the driving plunger member in a predetermined rotating angular position, one of said free lever ends is disengaged from said driving plunger member.

5 Claims, 6 Drawing Figures

LIMIT SWITCH

BACKGROUND OF THE INVENTION

This invention relates to a limit switch, and more particularly, to a limit switch for turning on or off a switch component such as a snap action switch through conversion of the rotational motion of a rotating shaft into the linear motion of a driving plunger.

Heretofore, a prior art limit switch has been provided with a selecting mechanism which, for example, depending on the intended application, is adjustable to drive a driving plunger only when a rotating shaft rotates in a predetermined direction and to prevent the driving plunger from being driven when the rotating shaft rotates in another direction. Such a selecting mechanism, however, has the disadvantage of structural complexity, requiring a tool and much labor for selection.

Therefore, it is an object of this invention to provide a limit switch, the operating direction of which is easily and stably selected by hand, i.e. without any tool.

It is another object of this invention to provide a limit switch which is easy to assemble.

It is still another object of this invention to provide a limit switch which is operable through a minimal rotational angle of a rotating shaft.

BRIEF DESCRIPTION OF THE PREFERRED EMBODYMENT

Figure 1:
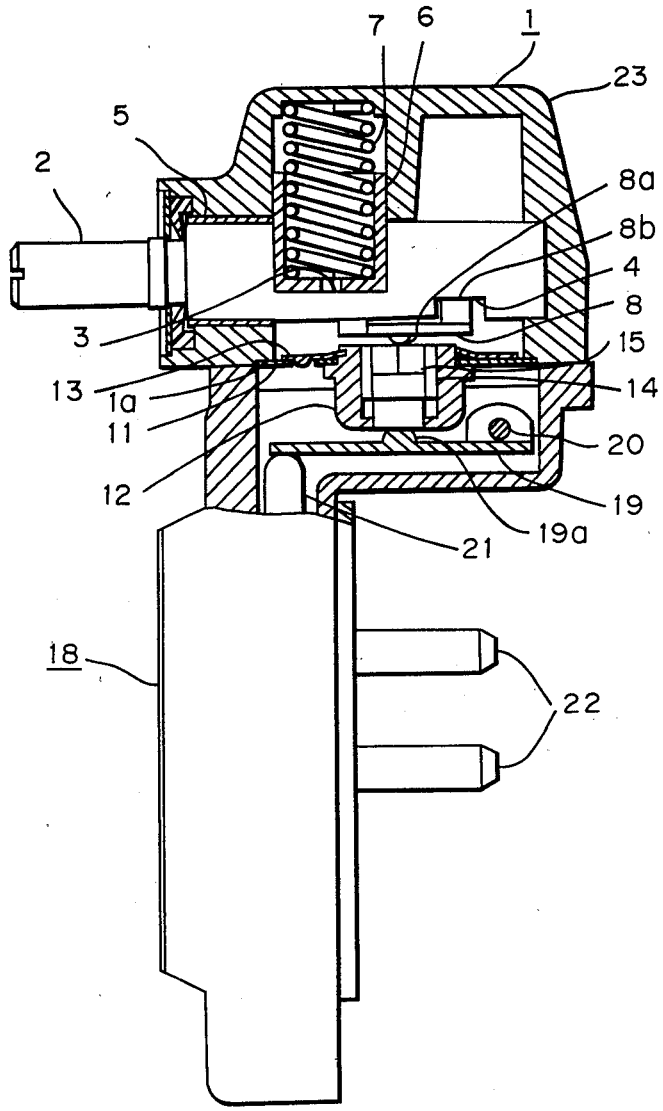
FIG. 1 is a schematic side view, in partial section, of a limit switch in accordance with the present invention.

The present invention is now described with reference to the drawings showing an embodiment of the present invention. FIG. 1 shows a limit switch in accordance with the present invention, which consists of a switch component 18 such as a snap action switch and an actuator 1 mounted on the switch component 18 and secured thereto by fastening means (not shown). The actuator comprises a casing 23, a rotating shaft 2 mounted on said casing 23 through a bearing 5, and an operating lever (not shown) detachably secured to the projecting end of said rotating shaft 2. The rotating shaft 2 is provided with an upper engaging recess 3 and a lower engaging recess 4. The actuator 1 further includes a return plunger 6 which is biased by a return spring (compression spring) 7 against the bottom surface of said upper recess 3, in which condition the operating lever or rotating shaft 2 is normally held in a predetermined angular position. Secured to the casing

Figure 2:
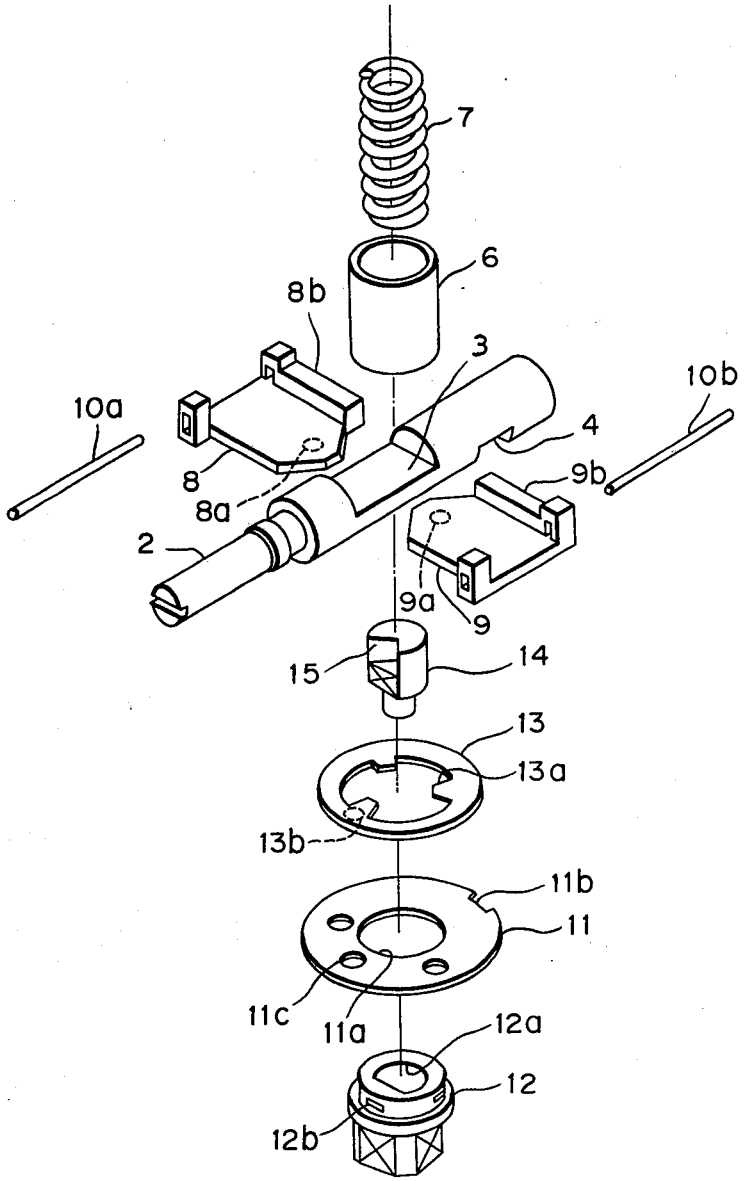
FIG. 2 is an exploded perspective view of main parts of the limit switch shown in FIG. 1.
Figure 3A:
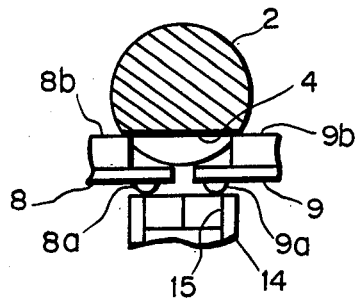
FIG. 3A is a schematic front view showing the relation between the rotating shaft and driving plunger shown in FIG. 1.

23, through pivot pins **10*a* and 10*b* under the rotating shaft 2, are levers 8 and 9, the lower surfaces of which are provided with projections 8*a* and 9*a* respectively. The levers 8 and 9 further have walls 8*b* and 9*b*, respectively, said upper projections being engageable with said engaging recess 4 of rotating shaft 2. A stationary plate 11 having a center hole 11*a* is secured to the casing 23 by insertion into a recess 1*a* thereof, closing an opening formed at the lower side of the casing 23. Engaged with a notch 11*b* of said stationary plate 11 is a projection (not shown) of said casing 23, for preventing the stationary plate 11 from rotating. Said stationary plate 11 may be more firmly secured to the casing 23 by crimping the peripheral wall defining said recess 1*a*. A selecting shaft 12 having a through-hole 12*a* in the center thereof is rotatably supported by the stationary plate 11. A positioning plate 13, of resilient material, having a plurality of projections 13*a* is attached to the upper portion of the selecting shaft 12 which projects upwardly from said stationary plate 11, said plurality of projections 13*a* being force-fitted into the corresponding notches 12*b* of the selecting shaft 12 which is, thereby, prevented from slipping out of the center hole 11*a* and enabled to be rotate together with said positioning plate 13. A projection 13*b* formed on the lower surface of the positioning plate 13 is slidably engaged with the upper surface of the stationary plate 11 which has a plurality of positioning holes 11*c*. The projection 13*b* positioned in one of the holes 11*c* indicates a predetermined angular position of the selecting shaft 12. A driving plunger member 14 having a cut-out portion 15 is positioned in the through-hole 12*a* of the selecting shaft 12, said driving plunger member 14 being vertically reciprocable but not rotatable. The switch component 18 is provided with an arm 19 pivotally secured by a pivot pin 20. The numeral 22 indicates a plurality of terminals of a snap action switch. The operation of thus constructed limit switch is described below. A buttom 21 of the switch component normally rotates the arm 19 clockwise and the projection 19*a* of the arm, in turn, presses the driving plunger member 14 upwardly. When no rotating force is applied to the rotating shaft 2 and the selecting shaft 12 is positioned in a predetermined angular position, both the projections 8*a* and 9*a* of levers 8 and 9 touch the upper surface of the driven plunger member 14, as shown in FIG. 3A. When the rotating force, clockwise as viewed in FIG. 2 and FIG. 3A, is applied to the rotating shaft 2, the rotating shaft 2 is rotated in a clockwise direction and the rotating force of the engaging surface of the rotating shaft 2 is transmitted to the wall 9*b* of the lever 9, with the result that the lever 9 is rotated downwards or counterclockwise. The lever 9 presses the driving plunger member 14 downwards which, in turn, rotates the arm 19 counterclockwise, whereby the button 21 is pressed downwards and the switch component is turned on or off. When the rotating force to the rotating shaft 2 is removed, the mechanism returns to the initial position. When the rotating force in a counterclockwise direction is applied to the rotating shaft 2**, an operation similar to the above is performed.

Figure 3B:
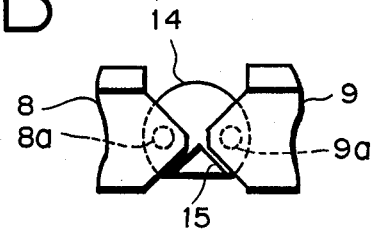
FIG. 3B is a schematic plan view showing the relation between the rotating shaft and driving plunger shown in FIG. 1.

Another mode of operation is now illustrated in which the switch component is driven only when the rotating shaft rotates in a predetermined direction. First the actuator 1 is detached from the switch component 18. Then, the selecting shaft 12 which projects downwardly from the stationary plate 11 is manually rotated to a desired position. The positioning plate 13 and plunger 14 are rotated with the selecting shaft 12. By this rotation, the projection 13*b* of the positioning plate in one of engaging holes 11*c* is moved and falls into the next hole. The relation between the driving member 14 and levers 8, 9, shown in FIG. 3A and FIG. 3B, is changed to that shown in FIG. 4A and FIG. 4B, i.e., the free end of the lever 8 falls into the cut-out portion 15 of the driving plunger member 14 and the wall 8*b* of the lever 8 is thereby disengaged from the engaging surface of the rotating shaft 2.

Figure 4A:
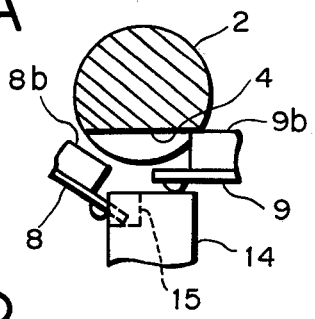
FIG. 4A is a schematic view showing a couple of levers, one of which is in a released position with respect to the driving plunger as the free end thereof is in engagement with the cut-out portion of said driving plunger.
Figure 4B:
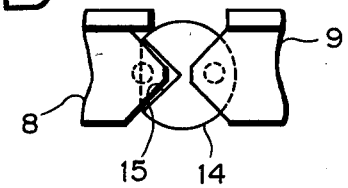
FIG. 4B is a schematic plan view showing the levers of FIG. 4A, where the free end of said one lever is in engagement with the cut-out portion of the plunger.

After the above preparation, the actuator 1 is mounted and secured to the switch component 18. When the rotating shaft 2 is rotated clockwise, as shown in FIG. 2 and FIG. 4A, the driving plunger member 14 is moved downwards by the lever 9. When the rotating shaft 2 is rotated counterclockwise, the driving plunger member 14 does not moved downwards. When the rotating force to the rotating shaft 2 is removed the mechanism returns to the initial position. It will be understood that the selecting shaft 12 or driving plunger member 14 may be set to the opposite rotating position to the above, in which case the driving plunger member 14 is moved downwardly only when the rotating shaft 2 is rotated in a counterclockwise direction.

As described above, the operating direction of the limit switch according to the present invention is easily and stably selected by hand. The actuator of the limit switch is easily assembled since most of the necessary parts, excepting the rotating shaft 2, are inserted into the casing 23 from one side there of. The actuator has a further advantage that the stroke of the driving plunger member 14 with respect to the rotating angle of the rotating shaft 2 is increased by the use of the levers 8 and 9.

What is claimed is:

1. A limit switch including a switch component and an acutator for driving said switch component, said actuator comprising:

a casing;

a shaft rotatable about its axis mounted within said casing, said shaft having a lever engaging portion;

a pair of levers pivotably supported under said shaft said levers being in a direction perpendicular to the axis of said rotating shaft, each lever having a free end extending from its pivot point, the free end of each lever opposing the free end of the other lever, the free ends of said levers being selectively engageable with the lever engaging portion of said shaft such that rotation of said shaft in a first direction causes said shaft engaging portion to press the free end of one of said levers, if engaged therewith, causing its pivotal movement and rotation of said shaft in a second direction causes said shaft engaging portion to press on the free end of the other of said levers, if engaged therewith, causing its pivotal movement; and, a vertically reciprocal driving plunger having an upper surface which is selectively engageable with a selected one of or both of said levers to control engagement of a selected one of or both of said levers with said lever engaging portion of said shaft, said plunger being vertically moved by the pivotal movement of a lever engaged with said upper surface caused by rotation of said shaft for driving said switch component.

2. The limit switch according to claim 1, wherein said driving plunger member is non-rotatably secured in a through-hole of a rotatable selecting shaft such that selective rotation of said selecting shaft causes selective rotation of said driving plunger member.

3. The limit switch according to claim 2, wherein said selecting shaft is rotatably supported by a stationary plate which is secured to a casing and is provided with a positioning means for positioning said selecting shaft in a desired rotated angular position.

4. The limit switch according to claim 3, wherein said positioning means comprises a member rotatable with respect to said stationary plate which indicates the angular position of said selecting shaft.

5. The limit switch according to claim 1, wherein each of said levers has a wall which is engageable with said engaging portion of the rotating shaft and has a projection which is engageable with said upper surface of the driving plunger member.

* * * * *